US007954535B2

(12) United States Patent
Ross

(10) Patent No.: US 7,954,535 B2
(45) Date of Patent: Jun. 7, 2011

(54) DRYWALL JOINT COMPOUND AND TAPE DISPENSER

(75) Inventor: Karl A. Ross, Liberty, MO (US)

(73) Assignee: Simple Man Products, LLC, North Kansas City, MO (US)

( * ) Notice: Subject to any disclaimer, the term of this patent is extended or adjusted under 35 U.S.C. 154(b) by 766 days.

(21) Appl. No.: 12/030,375

(22) Filed: Feb. 13, 2008

(65) Prior Publication Data

US 2009/0199971 A1 Aug. 13, 2009

(51) Int. Cl.
*B32B 37/12* (2006.01)
*E04F 21/165* (2006.01)

(52) U.S. Cl. ..... 156/575; 156/577; 156/578; 156/579

(58) Field of Classification Search ..... 156/574, 156/575, 577, 578, 579
See application file for complete search history.

(56) References Cited

U.S. PATENT DOCUMENTS

| | | | | |
|---|---|---|---|---|
| 2,502,499 | A | 4/1950 | Ames | |
| 3,116,195 | A | 12/1963 | Lathrop et al. | |
| 3,188,262 | A | 6/1965 | Torrison | |
| 3,707,427 | A | 12/1972 | Erickson | |
| 4,080,240 | A | 3/1978 | Dysart | |
| 4,086,121 | A * | 4/1978 | Ames | 156/526 |
| 4,105,490 | A | 8/1978 | Lass | |
| 4,116,748 | A | 9/1978 | Lass | |
| 4,127,434 | A | 11/1978 | Lass | |
| 4,775,442 | A | 10/1988 | Januska | |
| 5,013,389 | A | 5/1991 | Retti | |
| 5,230,608 | A | 7/1993 | Januska | |
| 5,279,700 | A | 1/1994 | Retti | |
| 6,294,034 | B1 | 9/2001 | O'Mara et al. | |
| 6,299,686 | B1 | 10/2001 | Mills | |
| 6,540,856 | B2 | 4/2003 | O'Mara et al. | |
| 6,565,252 | B2 | 5/2003 | Dillinger et al. | |
| 6,712,238 | B1 | 3/2004 | Mills | |
| 7,621,309 | B1 * | 11/2009 | Mondloch et al. | 156/526 |

* cited by examiner

*Primary Examiner* — Mark A Osele
(74) *Attorney, Agent, or Firm* — Stinson Morrison Hecker LLP

(57) ABSTRACT

A dispenser for dispensing a viscous substance and tape. The dispenser has a housing with an interior. An intake channel, main conduit, and tape channel are located within the interior. The intake channel receives the viscous substance and is in fluid communication with the main conduit. A first outlet is coupled with the main conduit for dispensing the viscous substance. The tape channel has an elongate slot adjacent the first outlet for dispensing the tape. A piston is slidable within the main conduit between a closed position blocking the flow of substance from the intake channel into the main conduit and an open position allowing substance to flow from the intake channel into the main conduit. The piston is pre-tensioned biasing the piston to the closed position.

25 Claims, 8 Drawing Sheets

DRYWALL JOINT COMPOUND AND TAPE DISPENSER

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

1. Field of the Invention

This invention relates generally to a dispenser and, more particularly, to a dispenser for dispensing a viscous substance and tape.

2. Description of Related Art

A typical apparatus and method for smoothing drywall cracks, joints, and seams includes mixing water with drywall joint compound to achieve a desired consistency, manually applying a thin layer of the joint compound to the crack, joint, or seam, embedding drywall tape in the joint compound layer, applying two successive layers of joint compound over the tape with a trowel, and sanding the excess joint compound to produce a smooth surface. This process is difficult and cumbersome, particularly for those with little experience. Often, it is difficult to smoothly embed the tape in the first layer of joint compound. Additionally, it is difficult to hold both a tape roll and a tray full of joint compound.

Devices have been disclosed in the past for simultaneously applying a layer of joint compound and tape. While these devices have utility, a need remains in the art for improved mechanisms.

It is, therefore, an object of the present invention to produce a device which can simultaneously apply joint compound and drywall tape to a joint, crack, or seam. It is an additional object to produce such a device that is lightweight, easy to clean, inexpensive, and easy to operate for a person having little experience.

BRIEF SUMMARY OF THE INVENTION

The present invention is directed toward a dispenser for dispensing a viscous substance, such as drywall joint compound, and tape. The dispenser housing defines an interior having an intake channel and main conduit. The intake channel receives the viscous substance and is in fluid communication with the main conduit. The main conduit is in fluid communication with an outlet for dispensing the viscous substance. A tape channel is located within the interior. The tape channel has an elongate slot adjacent the outlet for dispensing the tape.

In the preferred embodiment, the dispenser has a piston slidable within the main conduit between a closed position blocking the flow of the viscous substance from the intake channel into the main conduit, and an open position allowing the viscous substance to flow from the intake channel into the main conduit. In one embodiment, the piston is pre-tensioned biasing the piston to the closed position. Alternatively, a trigger may be coupled with the piston for sliding the piston between the closed and open positions. In this alternative embodiment, the trigger or the piston may be pre-tensioned biasing the piston to the closed position. The trigger or piston may also be operably coupled to a resilient member for biasing the piston to the closed position.

In the preferred embodiment, a source of viscous substance is coupled to the dispenser via the intake channel. Sliding the piston to its open position allows the substance to flow from the intake channel to the main conduit. As the user moves the dispenser over a surface, joint compound exits the outlet and tape exits the tape channel. The dispenser may be configured to release the viscous substance over the tape or the tape over the viscous substance. Alternatively, there may be two outlets which dispense the viscous substance on each side of the tape. The biased piston returns to its closed position upon release. The dispenser need not be cleaned after each use. Instead, it may simply be stored in a bucket of water to prevent joint compound from hardening within the device.

Additional aspects of the invention, together with the advantages and novel features appurtenant thereto, will be set forth in part in the description which follows, and in part will become apparent to those skilled in the art upon examination of the following, or may be learned from the practice of the invention. The objects and advantages of the invention may be realized and attained by means of the instrumentalities and combinations particularly pointed out in the appended claims.

DETAILED DESCRIPTION OF PREFERRED EMBODIMENT

Figure 1:
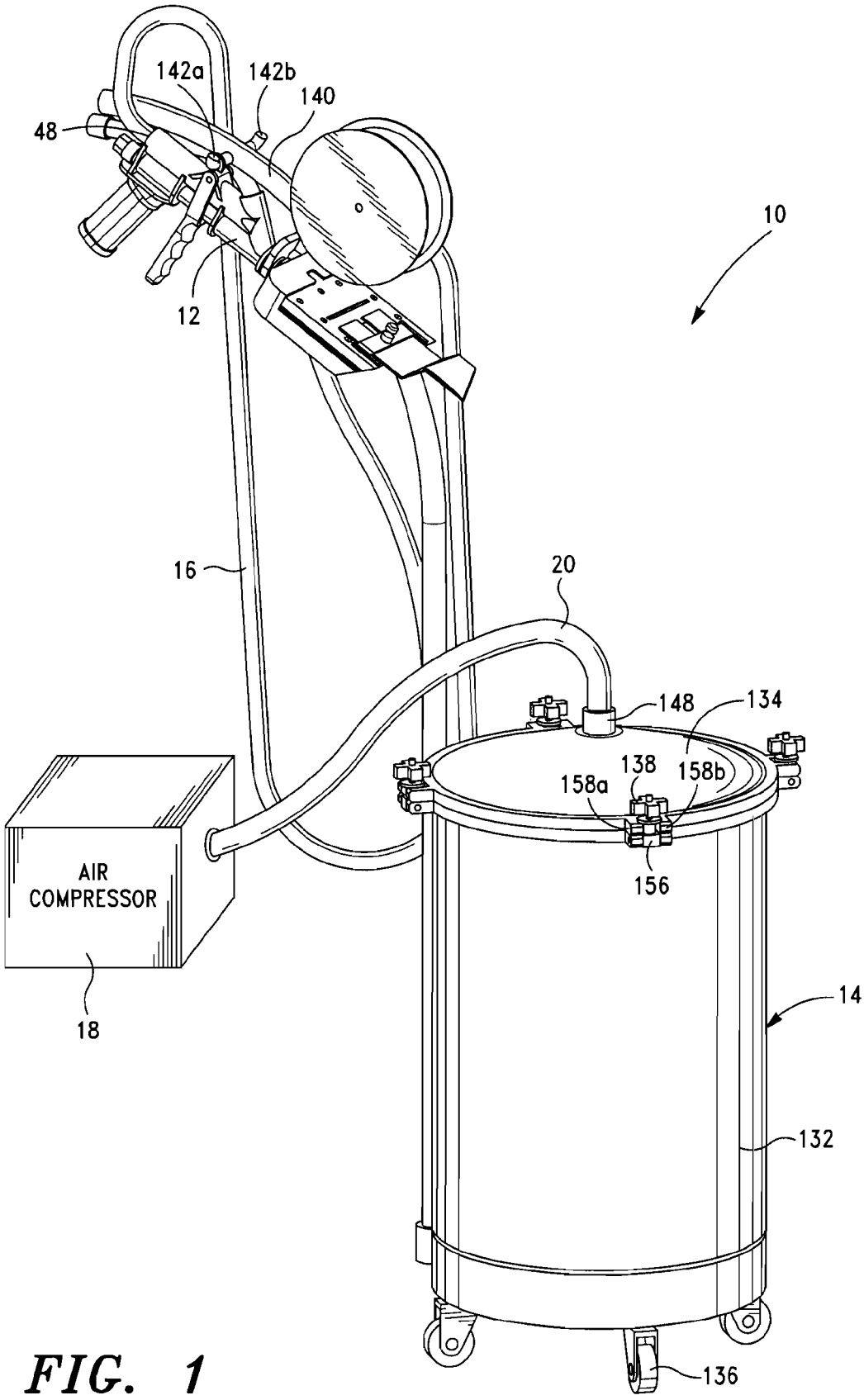
FIG. 1 is a perspective view of a dispensing system according to the present invention.

A dispensing system for dispensing a viscous substance and tape in accordance with the present invention is indicated generally as 10 in FIG. 1. Dispensing system 10 is particularly well adapted for dispensing drywall joint compound, but it is within the scope of the invention for the dispensing system to dispense other viscous substances. Dispensing system 10 has a dispenser 12 that is coupled with a tank 14 via a hose 16. An air compressor 18 is coupled with tank 14 via a hose 20.

Figure 2:
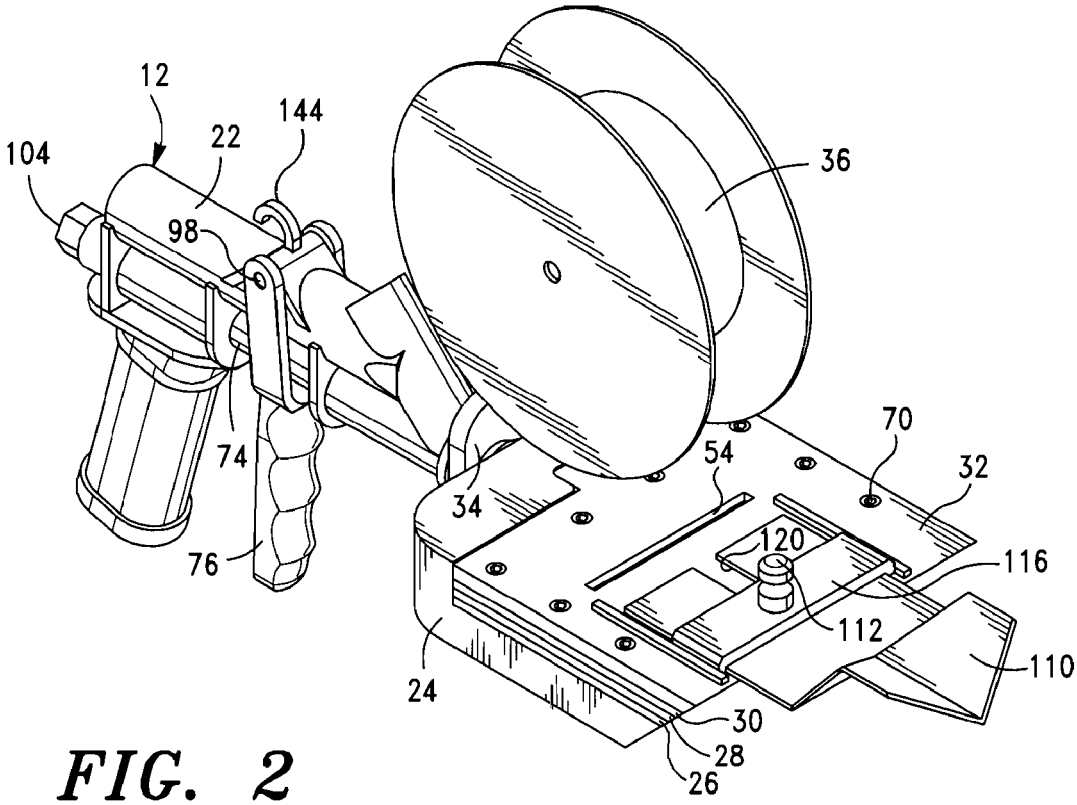
FIG. 2 is a front perspective view of the dispenser of the dispensing system of FIG. 1.
Figure 3:
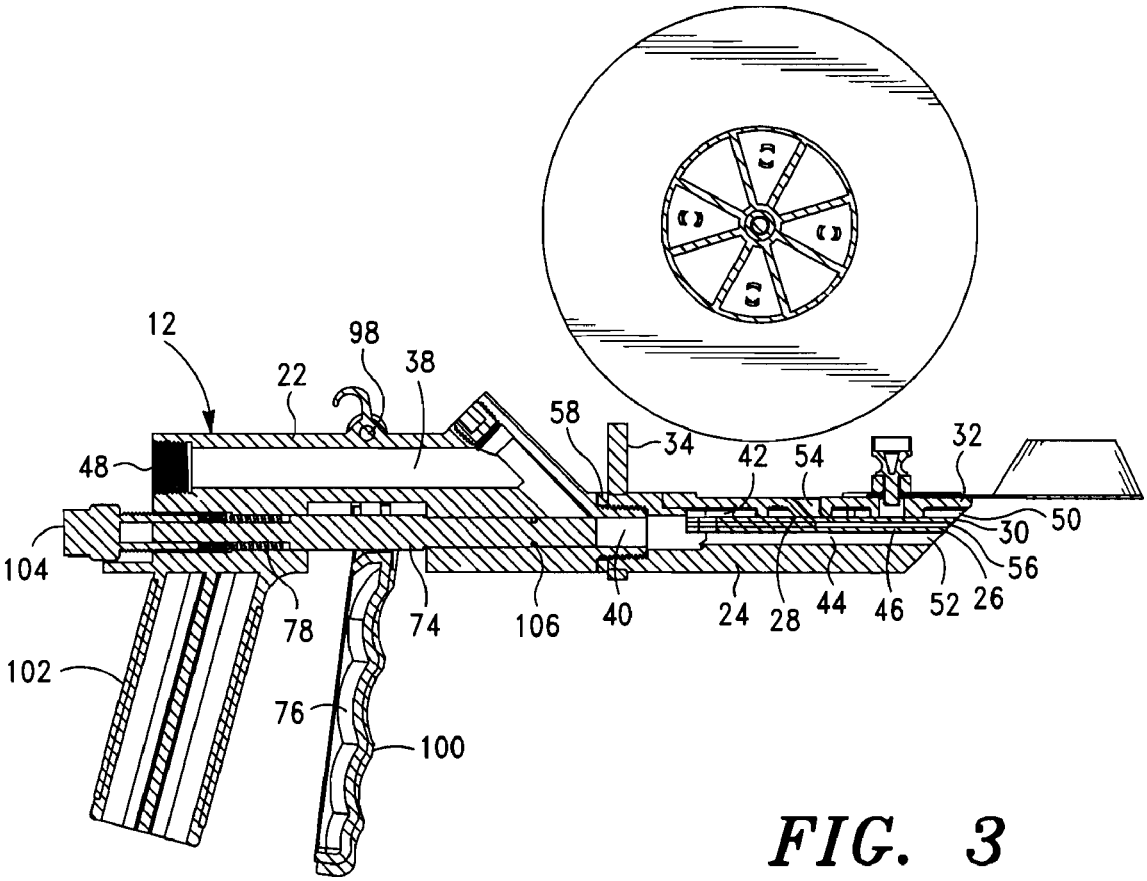
FIG. 3 is a side cross-sectional view of the dispenser.
Figure 4:
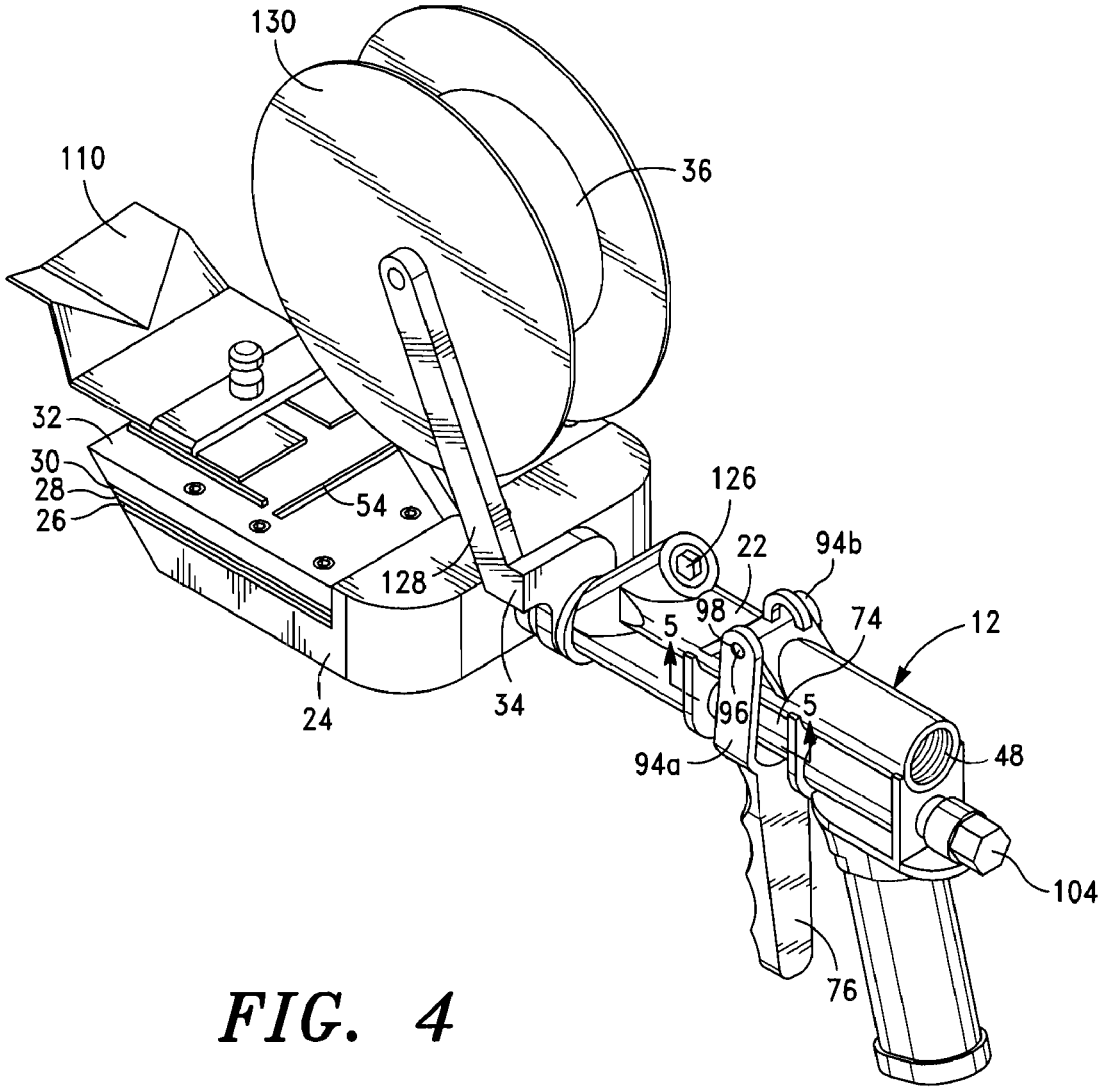
FIG. 4 is a rear perspective view of the dispenser.

FIGS. 2-4 show dispenser 12 having a gun housing 22, a base 24, a first plate 26, a second plate 28, a third plate 30 and a top plate 32. As best seen in FIG. 4, tape holder 34 is coupled with base 24 for holding a tape roll 36. FIG. 3 shows the interior of dispenser 12 with an intake channel 38, a main conduit 40 in fluid communication with the intake channel, upper and lower discharge passages 42 and 44 in fluid communication with the main conduit, and a tape channel 46. Intake channel 38 has an inlet 48 for receiving joint compound from hose 16, shown in FIG. 1. Dispenser 12 has a first outlet 50 and a second outlet 52 for dispensing the joint compound. Upper discharge passage 42 couples main conduit 40 and first outlet 50, and lower discharge passage 44 couples main conduit 40 and second outlet 52. Tape channel 46 has an entrance 54 in top plate 32 for receiving tape from tape roll 36, and an elongate slot 56 located between first and second outlets 50 and 52 for dispensing the tape. Tape channel 46 is not in fluid communication with intake channel 38, main conduit 40, or upper and lower discharge passages 42 and 44.

Figure 6:
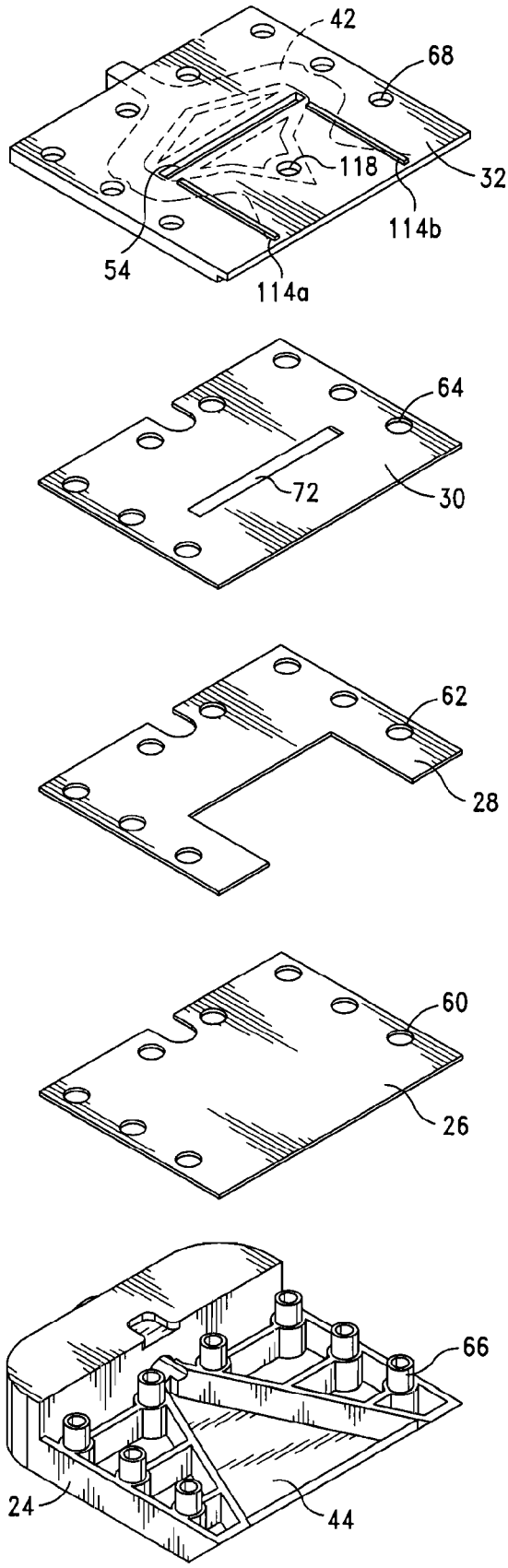
FIG. 6 is a partially exploded perspective view of a base, first plate, second plate, third plate and top plate of the dispenser.

As shown in FIG. 3, first plate 26 is located on top of base 24, second plate 28 is located on top of the first plate, third plate 30 is located on top of the second plate, and top plate 32 is located on top of the third plate. Base 24 is joined with gun housing 22 via female screw threads 23 which are received by male screw threads 25 on the gun housing. A lock washer 58 is positioned between base 24 and gun housing 22 to prevent unwanted separation of the two components. FIG. 6 shows first, second and third plates 26, 28 and 30 each having eight apertures 60, 62, and 64 aligned with eight hollow protrusions 66 extending upward from base 24. First, second, and third plates 26, 28, and 30 are seated onto base 24 with apertures 60, 62, and 64 receiving corresponding protrusions 66. Top plate 32 also has eight openings 68 each corresponding in size with a screw 70, shown in FIG. 2. Each screw 70 is received by a corresponding opening 68 and an upper portion of a corresponding hollow protrusions 66 for securing the base and plates together. Openings 68 in top plate 32 are preferably countersunk, allowing screws 70 to be flush with the outer surface of plate 32 when installed, as shown in FIG. 2.

Figure 7:
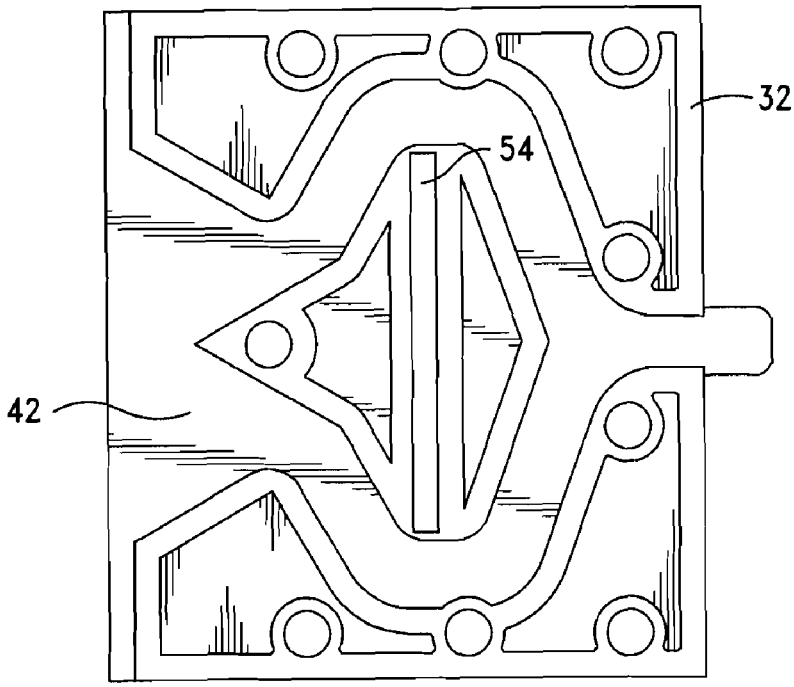
FIG. 7 is bottom plan view of the top plate of the dispenser.

Lower discharge passage 44 is located between base 24 and first plate 26 as shown in FIGS. 3 and 6. Upper discharge passage 42, shown in FIG. 7 and shown in phantom in FIG. 6, is located between top plate 32 and third plate 30. FIG. 6 shows a square-shaped gap in second plate 28. Tape channel 46 is defined by entrance 54 in the top plate, an opening 72 in the third plate, and first and third plates 26 and 30 enclosing the square-shaped gap in second plate 28. Elongate slot 56 is at the end of tape channel 46, as shown in FIG. 3.

Figure 11:
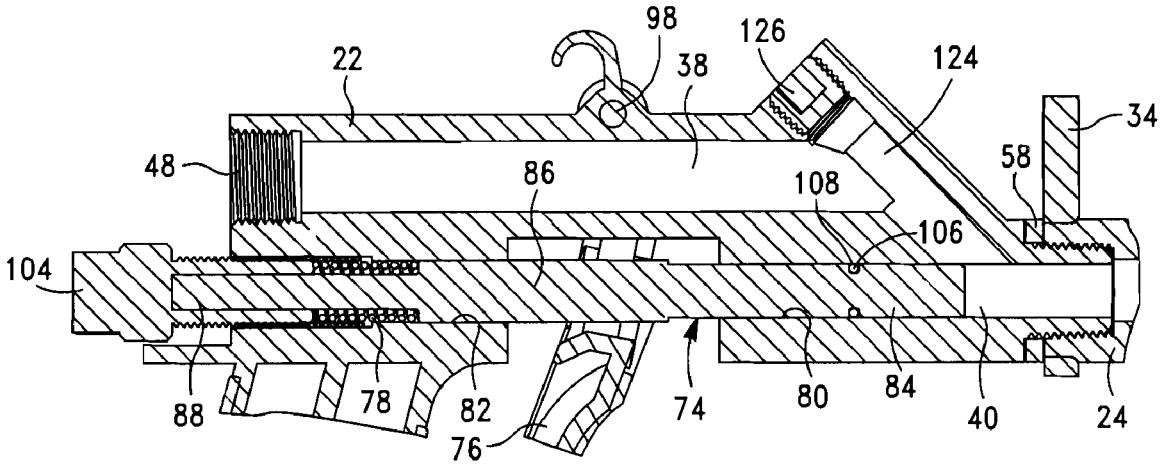
FIG. 11 is a partial cross-sectional view of the dispenser showing the piston in its open position.

Looking to FIG. 3, a piston 74 is positioned within main conduit 40. Piston 74 is slidable within main conduit 40 between a closed position blocking the flow of compound into the main conduit from intake channel 38 and an open position allowing compound to flow into the main conduit from the intake channel, as shown in FIG. 11. A trigger 76 is coupled with piston 74 for sliding the piston between the closed and open positions. The trigger and piston together define an actuator that is pre-tensioned biasing the piston to its closed position. A compression spring 78 biases the piston to its closed position. Although FIG. 3 shows a spring biasing piston 74 to its closed position, it is within the scope of the invention for any suitable device, including any type of resilient member, to bias the piston to its closed position. For example, a torsion spring may be coupled with trigger 76 at its axis of rotation for biasing the trigger and piston to the closed position.

As shown in FIG. 11, main conduit 40 is discontinuous and has a first section 80 and a second section 82. Piston 74 has a front portion 84, a middle portion 86, and a rear portion 88. Trigger 76 couples with middle portion 86 of piston 74 between first and second sections 80 and 82. The front portion and the rear portion of the piston each have a smaller diameter than the middle portion. Front portion 84 is received by first section 80 of the main conduit and middle and rear portions 86, 88 are received by second section 82 of the main conduit. Middle portion 86 has a larger diameter than first section 80 such that the lower front edge of the middle portion abuts the outer surface of gun housing 22 when the piston is in its closed position.

Figure 5:
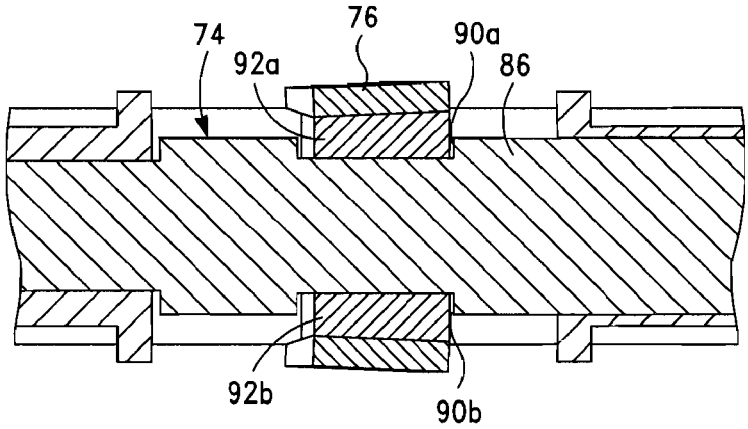
FIG. 5 is a cross-sectional view taken along the line 5-5 of FIG. 4 showing the coupling between the piston and trigger.

FIG. 5 shows middle portion 86 of piston 74 with a slot 90*a,b* on each side of the portion. Each slot 90*a,b* is received by a protruding section 92*a,b* of trigger 76, thus, coupling the trigger and piston. FIGS. 4 and 5 show trigger 76 with two legs 94*a,b* on either side of gun housing 22. FIG. 4 shows an opening 96 at the top of leg 94*a*. A pin 98 passes through opening 96 and an opening (not shown) in gun housing 22 to couple trigger 76 with the housing. Snap rings (not shown) preferably retain pin 98. Trigger 76 rotates around pin 98. As shown in FIG. 3, there is a soft cover 100 covering the lower portion of trigger 76. A soft handle cover 102 also covers the handle of gun housing 22. Both covers are preferably made from sanopreme, but it is within the scope of the invention to make the covers from any other material, or to omit the covers entirely.

FIG. 11 shows an adjustment knob 104 adjacent rear portion 88 of piston 74 when the piston is in its open position. Adjustment knob 104 is movable within second section 82 of main conduit 40 for adjusting the open position of the piston. Second section 82 has female screw threads which receive male screw threads on the adjustment knob 104. Turning adjustment knob 104 clockwise reduces the distance that piston 74 slides between its closed and open positions, which also reduces the amount of compound that flows from intake channel 38 to main conduit 40. Likewise, turning adjustment knob 104 counter-clockwise increases the distance that piston 74 slides between its closed and open positions, which also increases the amount of compound that flows from intake channel 38 to main conduit 40. Spring 78 encircles the rear portion of piston 74 and is positioned between adjustment knob 104 and middle portion 86 for biasing the piston to the closed position.

Looking to FIG. 11, an annular groove 106 is in the outer surface of the piston. Groove 106 is positioned within first section 80 of the main conduit. Groove 106 receives a resilient ring 108 for sealing first section 80 to ensure that no joint compound flows around the piston 74 to exit the first section near the trigger. When the piston slides from its open position to its closed position, groove 106 remains rearward of the location where intake channel 38 is in fluid communication with main conduit 40, as shown in FIG. 3.

Figure 8:
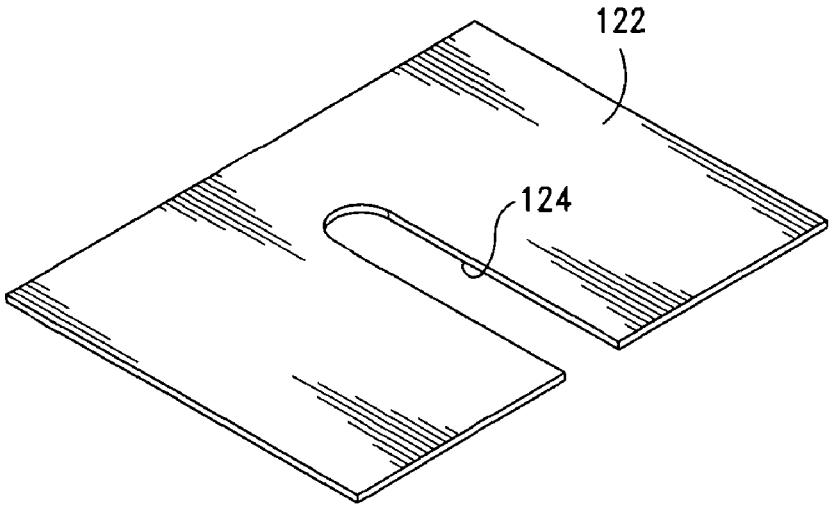
FIG. 8 is a perspective view of a blade adapted for coupling to the dispenser.

Looking to FIG. 2, a v-shaped blade 110 is coupled to top plate 32 with a screw 112. As shown in FIG. 6, top plate 32 has two parallel guides 114*a,b* protruding from the top surface of the plate. As shown in FIG. 2, guides 114*a,b* are spaced the width of blade 110 for properly orienting the blade on the housing. A blade support 116 is positioned between guides 114*a,b*. Blade support 116 has an opening (not shown) aligned over opening 118, shown in FIG. 6. Screw 112 is received by both openings and a slot 120 in the blade, as shown in FIG. 2. The v-shaped blade smoothes tape applied to a seam between non-parallel surfaces. As shown in FIG. 8, a flat blade 122 is used to smooth tape applied to a seam between parallel surfaces. Flat blade 122 also has a slot 124 adapted to receive screw 112. The slot enables a user to quickly change the blade. Preferably, each blade is used to smooth tape over a seam between drywall sheets, but it is within the scope of the invention for the blade to be used on other surfaces, or with other materials.

As shown in FIG. 11, a cleaning port 124 is in fluid communication with intake channel 38 and main conduit 40. The cleaning port 124 has female screw threads which are received by male screw threads on a plug 126. Plug 126 blocks the flow of joint compound through cleaning port 124 when the dispenser is in use.

As shown in FIG. 3, tape holder 34 encircles base 24 adjacent where the base couples with gun housing 22. FIG. 4 shows tape holder 34 having an arm 128 extending up to a spool 130 that holds the tape roll. Preferably, spool 130 is constructed from two sides that may be coupled and decoupled to install a tape roll on the spool.

Figure 9:
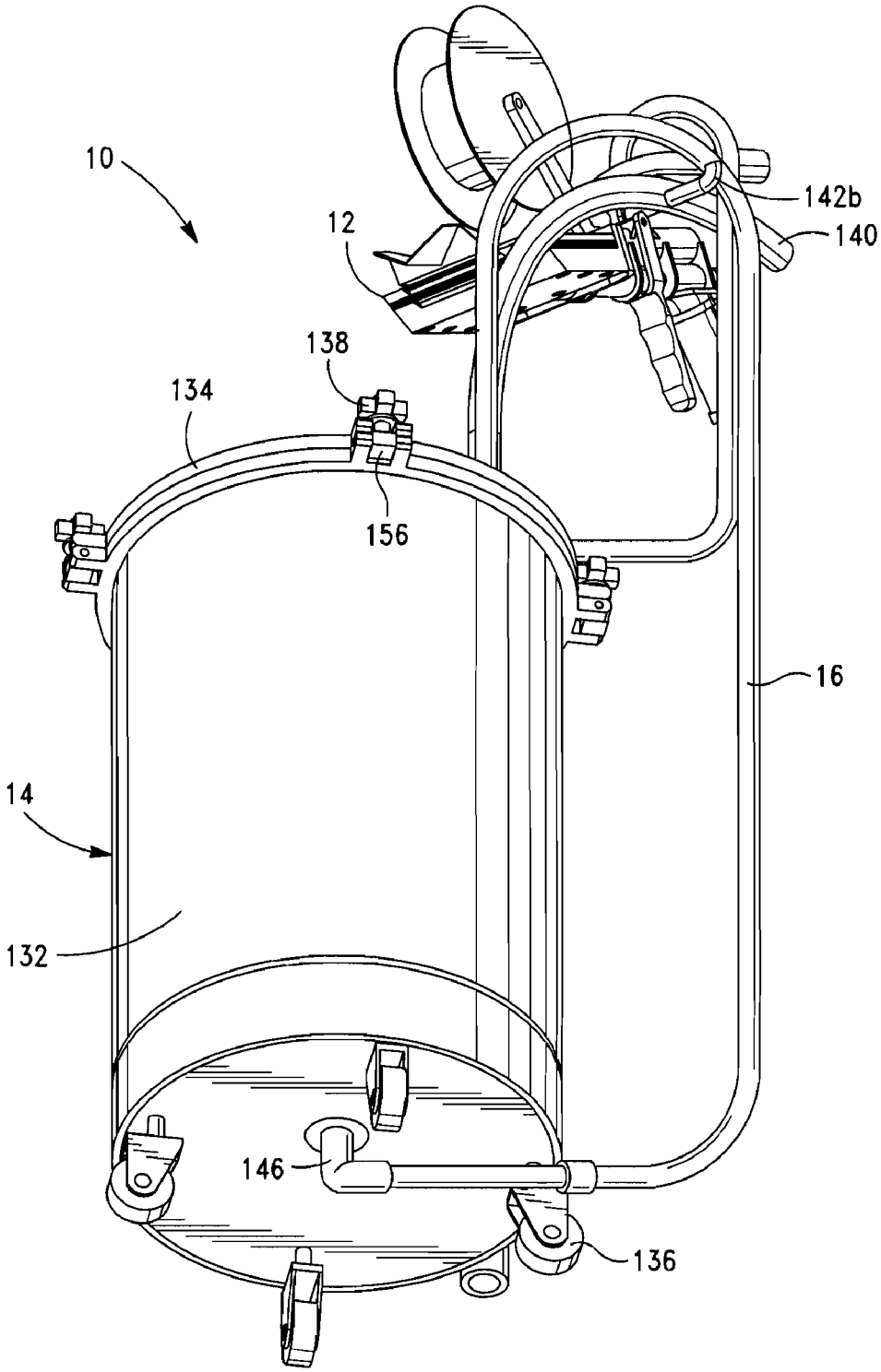
FIG. 9 is a perspective view of the dispenser of FIG. 1 showing the bottom of a tank.
Figure 10:
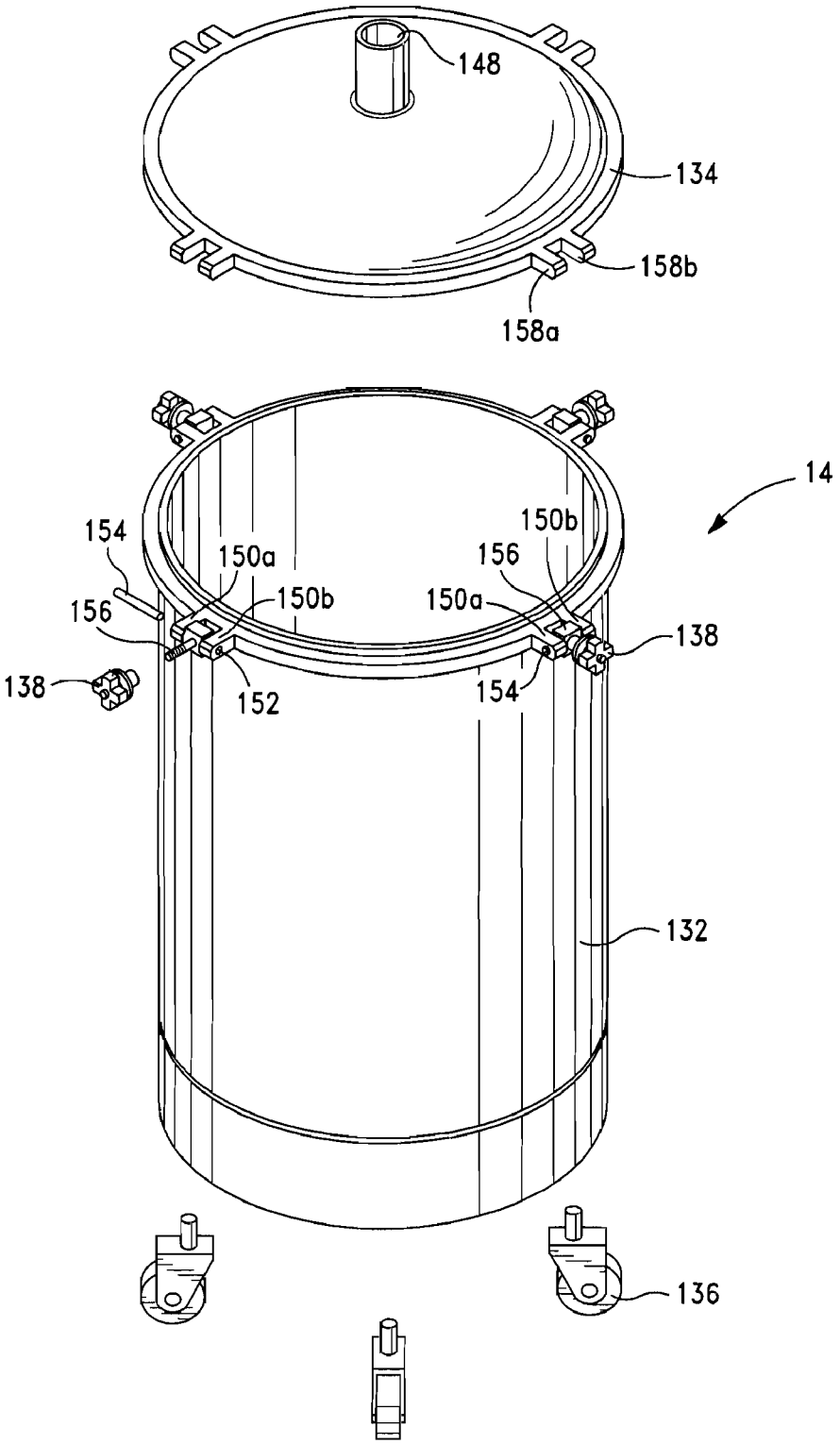
FIG. 10 is a partially exploded perspective view of the tank of the dispensing system of FIG. 1.

Looking to FIGS. 9 and 10, tank 14 has a cylindrical sidewall and closed bottom to form a bucket 132, a lid 134 covering the interior of the bucket, four caster wheels 136 extending from the bottom of the bucket, and four knobs 138 securing the lid to the bucket. FIG. 1 shows a handle 140 extending upward from the bottom of bucket 132 for maneuvering the tank. Near the top of handle 140, a J-shaped hook 142*a,b* extends from each side of the handle. J-shaped hook 142*a* couples with hook 144, shown in FIG. 2, at the top of dispenser 12 for storing the dispenser off the ground. FIG. 9 shows hose 16 looped around J-shaped hook 142*b* to keep the hose off the ground when rolling the dispenser.

Looking to FIG. 9, an outlet 146 on the bottom of bucket 132 is coupled with hose 16. As shown in FIG. 1, an inlet 148 on lid 134 is coupled with air compressor 18. Although an air compressor is shown, inlet 148 could be coupled with any pressurized air source. Air compressor 18 pressurizes the interior of bucket 132 to force substance stored within the tank through outlet 146 and hose 16. Four sets of spaced tabs 150*a,b* are positioned around the upper peripheral edge of cylinder 132 (FIG. 10). Each tab has an opening 152 adapted to receive a pin 154. A swing bolt 156 is positioned between each set of spaced tabs 150*a,b*. Pin 154 is received by openings 152 in the tabs 150*a,b* and an opening (not shown) in the swing bolt 156. Lid 134 has four sets of spaced tabs 158*a,b* corresponding to tabs 150*a,b* on bucket 132. When lid 134 is positioned on top of bucket 132, as shown in FIG. 1, each swing bolt 156 extends upward through tabs 158*a,b*. A knob 138 receives each swing bolt 156 securing the lid with respect to the cylinder. The swing bolt, pin, and knob are commercially available from the Carr Lane Manufacturing Company.

The components of the dispenser described above may be made from any material, such as metal, plastic, glass, or wood, and are not limited to the preferred materials specified herein. Preferably, gun housing 22, base 24, top plate 32, and trigger 76 are 33% glass filled nylon. Plates 26, 28 and 30, blades 110 and 122, piston 74 and spring 78 are preferably 303 stainless steel. All pins, fasteners, and snap rings are also preferably 303 stainless steel. Plug 126, screw 112 and adjustment knob 104 are preferably brass. Resilient ring 106 is preferably rubber. Tape holder 34 and blade support 116 are preferably nylon. Bucket 132, lid 134, and handle 140 are preferably steel.

Figure 12:
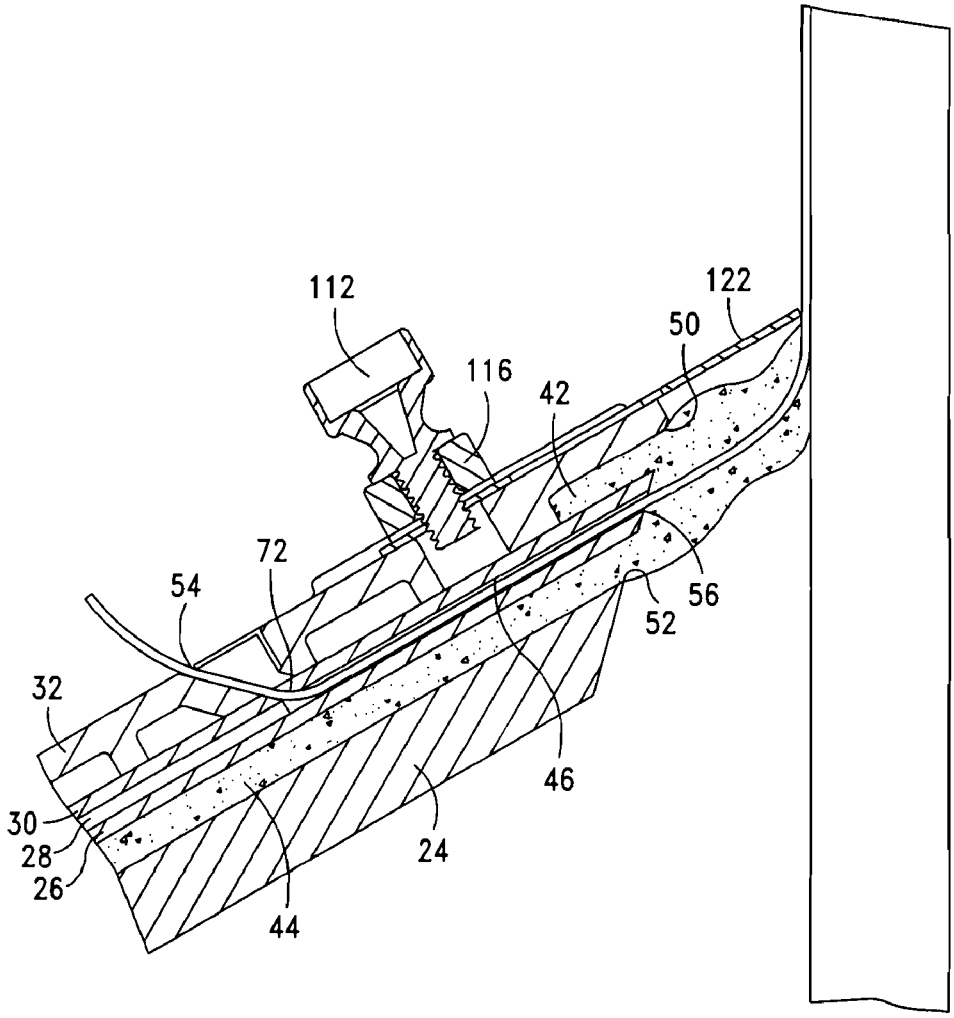
FIG. 12 is a partial cross-sectional view showing the dispensing system dispensing viscous substance and tape to a surface.

In operation, knobs 138 are rotated counterclockwise to remove lid 134 from cylinder 132, as shown in FIG. 10. Cylinder 132 is filled with joint compound or another suitable viscous substance. Lid 134 is replaced on cylinder 132, swing bolts 156 are positioned through tabs 158*a,b* and knobs 138 are turned clockwise until the lid 134 forms a seal with the cylinder. One end of hose 16 is connected to outlet 146 of cylinder 132 and the other end of hose 16 is connected to inlet 48 of housing 12, as shown in FIGS. 1 and 9. A tape roll 36 is mounted on tape holder 34 and the tape is fed through tape channel 46 until it comes out elongate slot 56, as shown in FIGS. 2 and 12. As shown in FIG. 1, an air compressor 18 is coupled with inlet 148 of lid 134 and powered on.

As shown in FIG. 12, first and second outlets 50 and 52 and elongate slot 56 are positioned against a seam between drywall panels. Trigger 76 is pulled back until piston 74 contacts adjustment knob 104, as shown in FIG. 11. Joint compound flows through intake channel 38 into main conduit 40 and into upper and lower discharge passages 42 and 44. The front of housing 12 is moved along the seam so that joint compound from second outlet 52 is deposited over the seam, followed by tape from elongate slot 56 and joint compound from first outlet 50. Blade 122 smoothes the compound and tape on the drywall. After the entire seam is covered, trigger 76 is released and spring 78 pushes piston 74 to its closed position.

It is not necessary to thoroughly clean housing 12 after use; instead, the housing may be placed in a bucket of water for storage. If the dispenser will be out of service for an extended period of time, then the housing may be cleaned by flushing water through clean-out port 124. Additionally, screws 70 may be removed to disassemble and clean base 24 and plates 26, 28, 30 and 32. Piston 74 may also be removed through the rear of main conduit 40 by removing adjustment knob 104 and decoupling the trigger and piston.

Thus, the dispenser described above dispenses both joint compound and drywall tape over a seam between drywall panels. The pre-tensioned piston enables the device to quickly shut off. The dispenser is easy to clean, lightweight and easy to operate. From the foregoing it will be seen that this invention is one well adapted to attain all ends and objectives herein-above set forth, together with the other advantages which are obvious and which are inherent to the invention.

Since many possible embodiments may be made of the invention without departing from the scope thereof, it is to be understood that all matters herein set forth or shown in the accompanying drawings are to be interpreted as illustrative, and not in a limiting sense.

While specific embodiments have been shown and discussed, various modifications may of course be made, and the invention is not limited to the specific forms or arrangement of parts and steps described herein, except insofar as such limitations are included in the following claims. Further, it will be understood that certain features and subcombinations are of utility and may be employed without reference to other features and subcombinations. This is contemplated by and is within the scope of the claims.

What is claimed and desired to be secured by Letters Patent is as follows:

1. A dispenser for dispensing a viscous substance and tape, said dispenser comprising:

a housing defining an interior;

an intake channel located within said interior and comprising an inlet for receiving a viscous substance;

a conduit located within said interior in fluid communication with said intake channel;

a first outlet coupled with said conduit for dispensing the viscous substance;

a tape channel located within said interior and comprising an entrance for receiving the tape and an elongate slot adjacent said first outlet for dispensing the tape; and a piston slidable within said conduit between a closed position blocking the flow of the viscous substance from said intake channel into said conduit and an open position allowing the viscous substance to flow from said intake channel into said conduit, wherein said piston is pre-tensioned to bias said piston to said closed position.

2. The dispenser of claim 1, further comprising a second outlet coupled with said conduit for dispensing at least a portion of the viscous substance, and wherein said elongate slot is located between said first and second outlets.

3. The dispenser of claim 1, wherein said tape channel is not in fluid communication with said intake channel and said conduit.

4. The dispenser of claim 1, further comprising an adjustment knob movable within said interior for adjusting said open position of said piston.

5. The dispenser of claim 1, further comprising a trigger coupled with said piston for sliding said piston between said closed and open positions.

6. The dispenser of claim 5, wherein said conduit is discontinuous and comprises first and second sections, wherein said trigger couples with said piston between said first and second sections, wherein said dispenser further comprises an adjustment knob movable within said second section of said conduit for adjusting said open position of said piston.

7. The dispenser of claim 6, wherein said second section of said conduit comprises female screw threads adapted to be received by male screw threads on said adjustment knob for moving said adjustment knob within said second section.

8. The dispenser of claim 6, wherein said piston comprises a front portion, a middle portion and a rear portion, said rear portion having a smaller diameter than a diameter of said middle portion, wherein said front portion is received by said first section of said conduit, and said rear portion is received by said second section of said conduit, and wherein said dispenser further comprises a resilient member encircling said rear portion of said piston and positioned between said adjustment knob and said middle portion of said piston for biasing said piston to said closed position.

9. The dispenser of claim 1, wherein said piston comprises an annular groove along an outer surface of said piston and a resilient ring is received by said annular groove.

10. The dispenser of claim 1, wherein said housing further comprises a cleaning port in fluid communication with said intake channel and said conduit, and wherein said cleaning port is adapted to receive cleaning fluid.

11. The dispenser of claim 1, further comprising a blade coupled with said housing for smoothing the tape after it is dispensed.

12. The dispenser of claim 11, wherein said blade is v-shaped for smoothing tape applied to non-parallel surfaces.

13. The dispenser of claim 1, further comprising a tank for storing the viscous substance, said tank comprising an inlet coupled with a pressurized air source and an outlet coupled with said inlet of said intake channel.

14. The dispenser of claim 1, further comprising:

a second outlet coupled with said conduit for dispensing the viscous substance, wherein said elongate slot is located between said first and second outlets;

an upper discharge passage coupling said conduit and said first outlet; and a lower discharge passage coupling said conduit and said second outlet.

15. The dispenser of claim 14 wherein said housing comprises a base, a first plate located on top of said base, a second plate located on top of said first plate, a third plate located on top of said second plate, and a top plate located on top of said third plate, wherein said lower discharge passage is located between said base and said first plate, said entrance of said tape channel is located in said top plate, said tape channel passes through an opening in said third plate, and said elongate slot of said tape channel is located between said first plate and said third plate, and wherein said upper discharge passage is located between said top plate and said third plate.

16. The dispenser of claim 15, wherein said housing comprises a gun housing removably coupled with said base, wherein said conduit is discontinuous and comprises first and second sections, wherein said piston comprises front, middle, and rear portions, said front portion and rear portion having a smaller diameter than said middle portion, wherein said front portion is received by said first section of said conduit, said middle portion has a larger diameter than said first section of said conduit such that it abuts the outer surface of said gun housing when said piston is in said closed position, and said rear portion is received by said second section of said conduit.

17. The dispenser of claim 16, wherein said second section of said conduit receives an adjustment knob adjacent movable within said second section of said conduit for adjusting said open position of said piston.

18. The dispenser of claim 17, further comprising a trigger coupled with said middle portion of said piston between said first and second sections of said conduit.

19. The dispenser of claim 18, further comprising a resilient member encircling said rear portion of said piston and positioned between said adjustment knob and said middle portion of said piston for biasing said piston to said closed position.

20. The dispenser of claim 1, further comprising a tape holder coupled with said housing, wherein said tape holder is adapted to hold a tape roll.

21. The dispenser of claim 1, wherein said viscous substance is drywall joint compound.

22. A dispenser for dispensing a viscous substance and tape, said dispenser comprising:

a housing defining an interior;

an intake channel located within said interior and comprising an inlet for receiving the viscous substance;

a conduit located within said interior in fluid communication with said intake channel;

a first outlet coupled with said conduit for dispensing the viscous substance;

a tape channel located within said interior and comprising an entrance for receiving the tape and an elongate slot adjacent said first outlet for dispensing the tape;

a piston slidable within said conduit between a closed position blocking the flow of the viscous substance from said intake channel into said conduit and an open position allowing the viscous substance to flow from said intake channel into said conduit;

a trigger coupled with said piston for sliding said piston between said closed and open positions, wherein said piston and said trigger together define an actuator; and a resilient member operably coupled with said actuator biasing said piston to said closed position.

23. The dispenser of claim 22, wherein said resilient member is a spring.

24. The dispenser of claim 22, wherein said resilient member is operably coupled with said piston biasing said piston to said closed position.

25. A dispenser for finishing a joint between sheets of drywall with joint compound and tape from a tape roll, said dispenser comprising:

a housing defining an interior;

an intake channel located within said interior and comprising an inlet for receiving the joint compound;

a conduit located within said interior and in fluid communication with said intake channel;

an upper outlet coupled with said conduit for dispensing the joint compound;

a lower outlet coupled with said conduit for dispensing the joint compound;

a tape channel located within said interior and comprising an entrance for receiving the tape and an elongate slot located between said upper and lower outlets for dispensing the tape;

a piston slidable within said conduit between a closed position blocking the flow of the joint compound from said intake channel into said conduit and an open position allowing the joint compound to flow from said intake channel into said conduit; and a trigger coupled with said piston for sliding said piston between said closed and open positions, wherein said piston and said trigger together define an actuator, and wherein said actuator is pre-tensioned biasing said piston to said closed position.

* * * * *